US006543760B1

(12) United States Patent
Andrén

(10) Patent No.: US 6,543,760 B1
(45) Date of Patent: Apr. 8, 2003

(54) METHOD AND DEVICE FOR SUCCESSIVELY FEEDING SHEETS FROM A STACK OF SHEETS

(75) Inventor: Erik Andrén, Lindesberg (SE)

(73) Assignee: EMBA Machinery AB, Örebro (SE)

( * ) Notice: Subject to any disclaimer, the term of this patent is extended or adjusted under 35 U.S.C. 154(b) by 95 days.

(21) Appl. No.: 09/678,739

(22) Filed: Oct. 4, 2000

(30) Foreign Application Priority Data

Aug. 3, 2000 (SE) ..... 0002818

(51) Int. Cl.[7] ..... B65H 3/08
(52) U.S. Cl. ..... 271/99; 271/112
(58) Field of Search ..... 271/99, 112, 114, 271/4.08, 10.09; 414/797.7

(56) References Cited

U.S. PATENT DOCUMENTS 4,045,015 A 8/1977 Sardella
4,614,335 A 9/1986 Sardella
5,006,042 A 4/1991 Park
5,048,812 A * 9/1991 Holmes ..... 271/11
5,219,157 A * 6/1993 Takahashi ..... 271/114
5,451,042 A * 9/1995 Cuir et al. ..... 271/112

* cited by examiner

*Primary Examiner*—David H. Bollinger
(74) *Attorney, Agent, or Firm*—Burns, Doane, Swecker & Mathis, LLP

(57) ABSTRACT

The invention relates to a device for feeding sheets one by one from a stack of sheets to a transportation device. The sheet-feeding device comprises a number of parallel, separately driven shafts which are equidistantly spaced from one another and are enclosed in a first and a second low-pressure chamber and carry a plurality of feeding wheels which protrude through associated openings in the feeding table, which forms the top side of the respective low pressure chambers. A sheet support is arranged above one of the shafts in the first low-pressure chamber, and at least one sensor is arranged at the second low-pressure chamber. The sensor detects the front edge of the fed sheet and sends signals to a control unit for correcting, if necessary, the position of the sheet by controlling the motors associated with the shafts. The invention also relates to a method for feeding sheets.

20 Claims, 9 Drawing Sheets

"Standard" cam / movement pattern $t_s$ = time for skidding on a sheet
$t_0$ = starting point of retardation / stop Movement pattern where retardation occurs by a maximum braking torque $t_s$ = time for skidding on a sheet
$t_0$ = starting point of retardation / stop Change of sheet length Leaving may occur at e.g. $t_0$, $t_1$ or $t_2$ depending on sheet length

METHOD AND DEVICE FOR SUCCESSIVELY FEEDING SHEETS FROM A STACK OF SHEETS

FIELD OF THE INVENTION

The present invention relates to a device for feeding sheets one by one from a stack of sheets to a transportation device for transporting the sheet to a process station, the device comprising a first low-pressure chamber with an integrated feeding table which supports the stack of sheets, a number of separately driven shafts which are positioned perpendicular to the direction of transportation and are arranged in the low-pressure chamber essentially equidistantly spaced from one another and which each carry a plurality of wheels with friction lining, which protrude through associated openings in the feeding table, and a sheet support which is arranged essentially vertically above the feeding table and at a distance from the feeding table which is somewhat larger than the thickness of a sheet. The invention also relates to a method for feeding sheets one by one from a stack of sheets to a transportation device for transporting the sheet to a process station.

The invention especially relates to, but is not limited to, a method and a device for feeding or punching of cardboard blanks, for instance corrugated cardboard, from a stack of blanks to a machine for applying text and/or symbols or for punching.

BACKGROUND OF THE INVENTION

The problems which arise when feeding a (lowermost) sheet of a stack can be explained by the fact that, in practice, it is impossible to feed a sheet without a certain degree of skidding between feeding wheels and sheet, which causes insufficient repeatability. This is due to the fact that the friction between wheels and sheet changes with the continuously changing number of sheets in the sheaf, type of sheet (surface structure, thickness/weight etc.), changes in speed etc. In order to minimize the sliding between wheels and sheet, a large vacuum (negative pressure) has to be used. However, this implies that the next sheet is put down too fast and gets in contact with the retarding feeding wheels, which damages the sheets and wears the wheels out. There is also a risk that the next sheet is fed towards the front sheet support, which results in damage to the front edge of the sheet. This can also lead to the sheet feeding being interrupted when jamming occurs, i.e. two sheets (the one to be fed and the sheet on top thereof) are fed simultaneously into the gap between the sheet support and the feeding table and get stuck. Theoretically, this would be counteracted if a motor with a sufficient braking torque could be used. Then it would, theoretically, be possible to retard the wheel shafts in a considerably shorter time or over a considerably shorter distance. However, this is limited by the performance of commercially available motors which have either too high a maximum torque or too high a mass-moment of inertia. In order to counteract the above-mentioned problems, the vacuum has to be decreased, which has a detrimental effect on the repeatability when uncontrollable sliding (which also depends on the speed, the height of the sheaf etc.) appears.

A sheet-feeding device of the type defined above is already known from the U.S. Pat. No. 5,006,042. This known sheet-feeding device comprises a low-pressure chamber having an integrated feeding table on which a stack of sheets is intended to be placed, and a sheet support at a distance above the feeding table in the order of the thickness of one sheet. A number of shafts are arranged in the low-pressure chamber. The shafts carry a plurality of wheels which protrude through openings in the feeding table and serve to transport the lowermost sheet of the stack through the gap between the feeding table and the sheet support to a belt conveyor. Each shaft is driven by a separate motor. With reference to the reasoning above and to the fact that the distance is relatively large between the wheel shaft closest to the sheet support and on the one hand the sheet support and, on the other hand, the belt conveyor, there is an imminent risk that the sheets arrive inclined and/or with so-called index deviation at the belt conveyor with ensuing problems in the subsequent process station(s). No correction for the above-mentioned deficiencies is indicated in said patent. Furthermore, waiting sheets in the stack or sheaf, which due to frictional forces are pressed towards the sheet support (especially at a high level of vacuum), tend to get stuck with their front edge on the sheet support and, thus, be prevented from being correctly put down when sheets that are being fed have completed their feeding cycle. Often a corner of the front edge is pressed against the sheet support. Once the feeding cycle starts, the sheet is damaged or stuck on the sheet support and is not fed in a correct way.

Other problems that are related to sheet-feeding devices of the above-mentioned type are, for example, the following ones: If a "normal" so-called cam (movement pattern) in the sheet-feeding cycle is used (see FIG. 7*a*), when changing the speed, the acceleration and retardation ramps (the inclination of the graphs) will change. This implies that, at decreased machine speed, lower retardation of the feeding wheels and longer time to stop the wheels are obtained, although a force for bringing about a faster stop is available in the motor. Consequently, there will be enough time for the next sheet of the sheaf to be sucked down onto the wheels before they have stopped. As a result, the surface layer of the sheet could be damaged by the wheels which spin intensively against the same ("rubbing") and the sheet is advanced to the front sheet support in an uncontrolled manner. Variations in parameters, such as size of sheet, height of sheaf, level of vacuum and machine speed, also result in a change in the total friction acting between sheet and wheels. The variations in friction give rise to variations in the sliding between sheet and wheels which always occurs in connection with the acceleration of a sheet. When the sliding varies, it appears as variations in the index of the sheet. Moreover, there is the ubiquitous stochastic variations in friction from one sheet to another depending on, inter alia, the individual surface structure of each sheet, turbulence in vacuum boxes (low-pressure chambers) etc. which give a stochastic index adding to the above-mentioned reasons for inadequate repeatability.

An object of the present invention is to provide a device and a method for feeding sheets which minimize risks of index errors and inclination of the fed sheets.

Another object of the invention is to provide a device and a method for feeding sheets which prevent a sheet from jamming on or below the sheet support.

Yet another object of the invention is to provide a device and a method for feeding sheets which reduce the risk of damage to the surface layer of the sheets.

Furthermore, an object of the invention is to provide a sheet-feeding device which can easily be adapted to stacks or sheaves of sheets of various dimensions.

SUMMARY OF THE INVENTION

These objects have been achieved by means of a sheet-feeding device as stated by way of introduction, which is characterized in that the device further comprises a second low-pressure chamber, between the first low-pressure chamber and said transportation device, having an integrated feeding table which forms an extension of the feeding table of the first low-pressure chamber, that a number of separately driven shafts are arranged in the second low-pressure chamber at essentially the same said distance from one another and having said distance between adjacent shafts in the first low-pressure chamber and in the second low-pressure chamber, respectively, each shaft in the second low-pressure chamber carrying a plurality of wheels with friction lining, which protrude through associated openings in the feeding table of the second low-pressure chamber, that at least one sensor is arranged between the second low-pressure chamber and said transportation device, the sensor being arranged to detect the position of the front edge of the fed sheet and to send signals to a control unit, and that the control unit is adapted to correct, if necessary, the position of the front edge of the sheet by controlling the drive motors of the shafts.

A method for feeding sheets by means of a sheet-feeding device as described above is characterized in that the wheels, from being immobile at the beginning of each feeding cycle, are caused to rotate by means of a control unit which is connected to the drive motors of the wheels and said process station, in order to accelerate the sheet, so that the it reaches its position reference value and its speed reference value depending on the working pace of the process station, and that the respective wheels, when the sheet leaves the wheel, are brought to a standstill by means of the maximum braking torque available.

Further developments of the device and the method according to the invention will be evident from the features that are stated in the subclaims.

BRIEF DESCRIPTION OF THE DRAWINGS

A preferred embodiment of the invention will be illustrated in the following by way of example and with reference to the accompanying drawings, in which.

DESCRIPTION OF PREFERRED EMBODIMENTS

The sheet-feeding device or the feeding according to the invention is a unit which is included in a machine for converting corrugated cardboard or cardboard. In the process before converting, rectangular sheets are made which are cut in a format that suits exactly the box, trough or something else that is to be converted. The sheets are transported by means of, for example, a roller-conveyor system to the converting machine, where the sheets are entered manually or by means of a feeder in the cartridge of sheets of the feeding.

The purpose of the feeding is to feed the sheets so that the sheets enter "pacingly" and at a speed that is pre-set for the machine, the speed having the highest possible repeatability. The sheets are oriented in the cartridge of sheets of the feeding, so that the sheets are fed as straight as possible. Furthermore, the feeding itself must not contribute to the sheets being fed skewedly (oblique feeding). Since corrugated cardboard is sensitive to high surface pressure, it is advantageous to "calender" the sheets as little as possible (which occurs, for instance, in a press roll nip) when the sheets are drawn out of the sheaf (the lowermost sheet is fed and the stack-is supplied with sheets from the top in order to have a continuous feeding). Units that are arranged after the feeding may be printing, slitting, punching and folding units.

Referring first to FIGS. 1–4, a couple of preferred embodiments of the sheet-feeding device according to the invention have been illustrated. The device is particularly suitable for feeding sheets when a high accuracy is required as regards the positioning and angular orientation of the front edge of the sheet. Moreover, the device allows already printed sheets to be fed having the print downwards, that is, facing the feeding table without scratching or damaging the print. The function of the device is, as described above, to feed sheets 1 one by one from a stack of sheets via a transportation device 2 to a process station (not shown), such as a punch or a folding unit. The transportation device 2 may be a so-called vacuum conveyor, that is, a number of parallel conveyor belts which are arranged in a chamber with negative pressure or a "vacuum box". This does not constitute a part of the invention and can, for example, be of the type presented in the patent U.S. Pat. No. 5,006,042.

Figure 3:
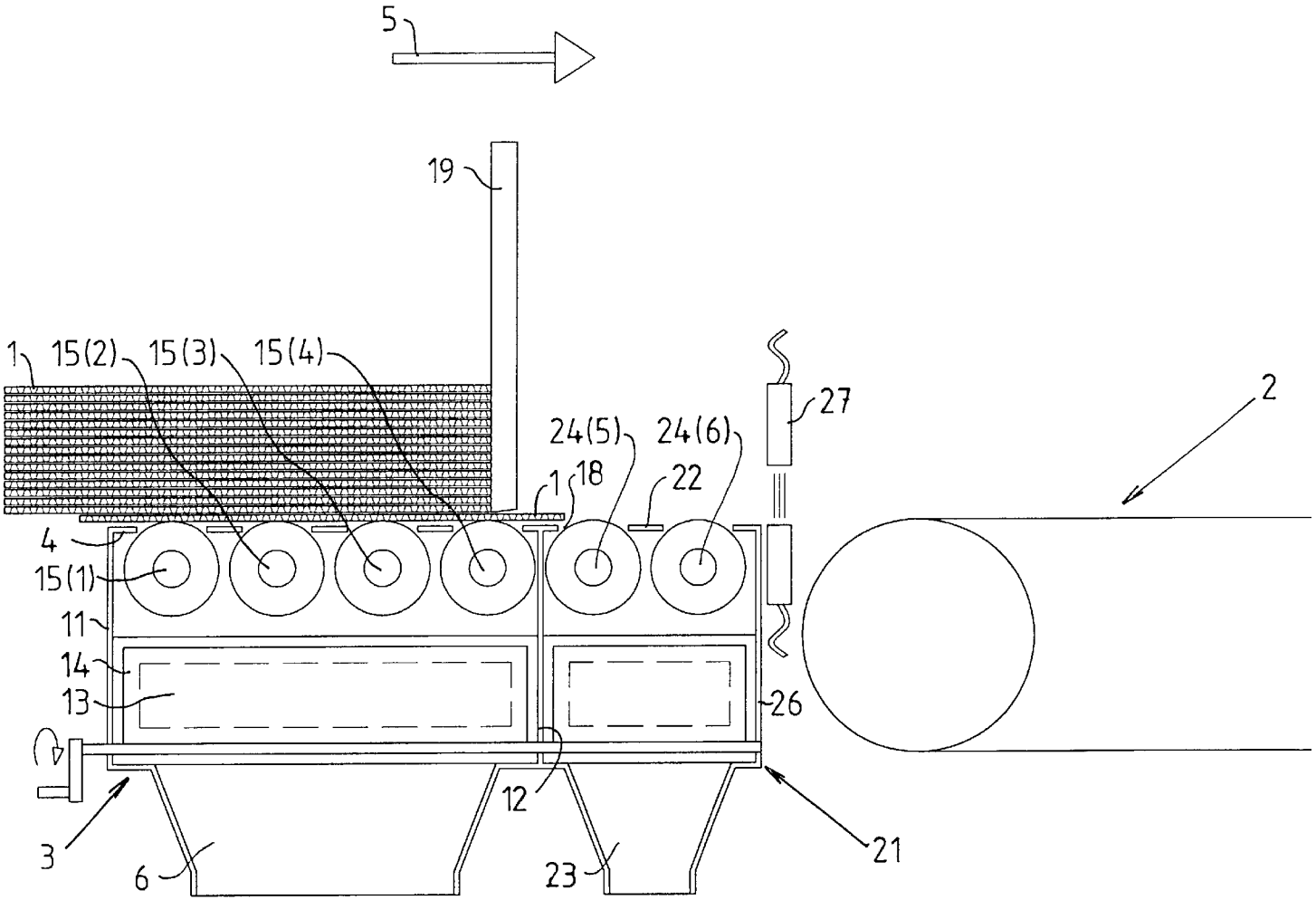
FIG. 3 is a vertical cross-sectional view of the device in FIG. 1, having a feeding table and a sheet support, along the line A—A.

The sheet-feeding device (feeding table) comprises a first low-pressure chamber or a "vacuum box" 3 with a feeding table 4, on which the stack of sheets rests, which has been schematically shown in FIG. 3. The feeding table is formed integrally with the low-pressure chamber 3 and forms its top side or upper portion. The low-presssure chamber is divided transversely to the direction of transportation of the sheets, which has been indicated by an arrow 5 in FIG. 3, in a central low-pressure compartment 6 and a number of smaller compartments 6' on both sides of the central compartment. Each compartment 6' is closed downwards by the bottom 7 of the low-pressure chamber 3 (see FIG. 4) and laterally, transversely to the direction of transportation, by partition walls 8 and an end wall 9, respectively. Laterally, along the direction of transportation, each compartment 6, 6' is defined by a common end wall 11 and 12, respectively. In each partition wall 8, there is an opening 13, which has been indicated by dashed lines in FIG. 3. By means of these openings, the low-pressure compartments 6' are connected to one another and the central compartment 6 which, in its turn, is connected to a suction fan or a suction pump in order to generate negative pressure (partial vacuum) in the low-pressure chamber 3. The openings 13 in the partition walls are separately closable by means of associated, individually operable flaps 14, whereby the effective width of the low-pressure chamber transversely to the direction of transportation can be controlled, depending on the number of compartments 6' which at the moment are connected to, as regards (negative) pressure, to the central compartment 6. Thus, the low-pressure chamber 3 can be adapted to the width of the fed sheets 1.

In the feeding table 4, a number of shafts 15 are arranged parallel to one another, transversely to the feeding direction, and are essentially equidistantly spaced from one another. Each shaft 15 is driven by a separate motor, preferably a servomotor 16 which is connected to a control unit or a control system 20 to be further explained in the following. The shafts 15 may extend through the entire low-pressure chamber 3 (see FIG. 2) or, as has been illustrated in FIG. 1, be divided into two separate shaft portions 15' that are aligned with one another having one motor 16 each. It is also possible to let some of the shafts 15 be divided (preferably the shafts closest to the end wall 12) and let the other shafts be undivided. Advantageously, the relative distance between the shafts 15 is kept as small as possible. The shafts 15 are journalled in the partition walls 8 and are in the same (horizontal) plane. A plurality of wheels 17 are fixedly (and detachably) arranged on each shaft 15 and have friction lining of, for instance, polyurethane on its peripheral surface. When using undivided shafts 15, the distance between adjacent shafts can be made so small that the wheel 17 of a shaft protrudes between the adjacent wheel of the shaft as is shown in FIG. 2. From this figure, it is also evident that the end wall 12 in this case may have an undulating or corrugated form shown in a top plan view.

Figure 4A:
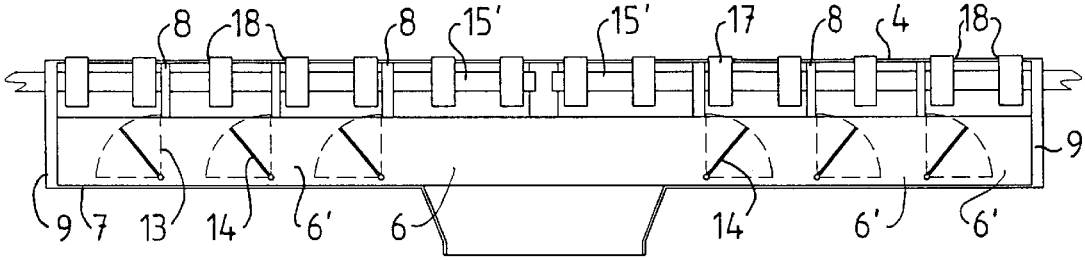
FIGS. 4*a* and 4*b* are vertical cross-sectional views of the device in FIGS. 1 and 2, respectively, perpendicular to the cross-section A—A, along the line B—B, FIG. 5 schematically shows the control unit of the device according to the invention.
Figure 4B:
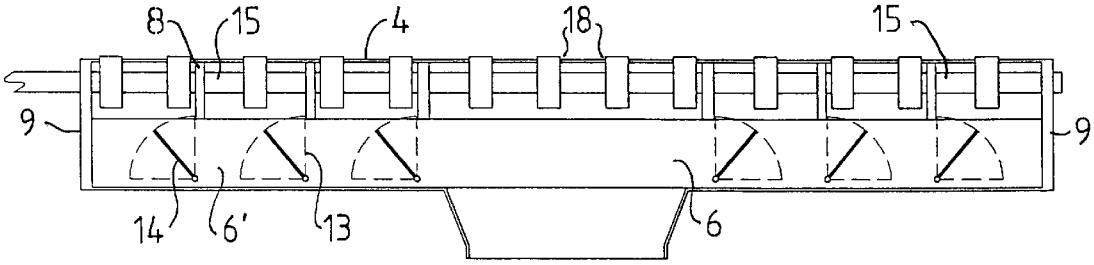

The feeding table 4 is provided with a plurality of openings 18 which in number correspond to the total number of wheels 17 and the wheels 17 protrude a short distance (about 3–5 mm) above the feeding table, see FIGS. 3 and 4. The openings 18 do not fit tightly round the wheels 17, whereby negative pressure is generated on the upper side of the feeding table 4 by means of suction effect from the low-pressure compartments 6, 6', which has been discussed above. The relative distance between the wheels 17 is adapted in such a manner that the (lowermost) sheet does not collapse between the wheels due to the negative pressure. The negative pressure between the lowermost sheet and the upper side of the feeding table results in the sheet being pressed against the coated wheels and it is secured that there is, by a wide margin, a higher frictional force between sheet and wheels than between the lowermost sheet and the next one. The force is so much larger that there is room enough for the contribution from the acceleration by the lowermost sheet in order to avoid sliding. Furthermore, this arrangement gives a minimum moment of inertia.

The distance between the shafts, the diameters of the wheels, the distance between the wheels and the feeding table are adapted so that thin sheets will not collapse and besides there is a safe hold of the sheet during the feeding phase. The wheels overlap in order to obtain maximum bearing capacity in relation to the sheets.

A sheet support or a "gate" 19 is arranged essentially vertically above the feeding table 4, parallel to the wheel shafts 15 and at a distance from the feeding table that is somewhat larger than the thickness of a sheet. Preferably, the sheet support 19 is displaceable in its plane, so that the gap between the sheet support and the feeding table can be adapted to various sheet thicknesses. The low-pressure chamber 3 extends past the sheet support 19 and one of the shafts 15, i.e. the shaft 15(4) in FIG. 3, is essentially positioned in the same plane as the sheet support, which gives a reliable feeding of the lowermost sheet past the sheet support 19 towards the transportation device 2.

Figure 1:
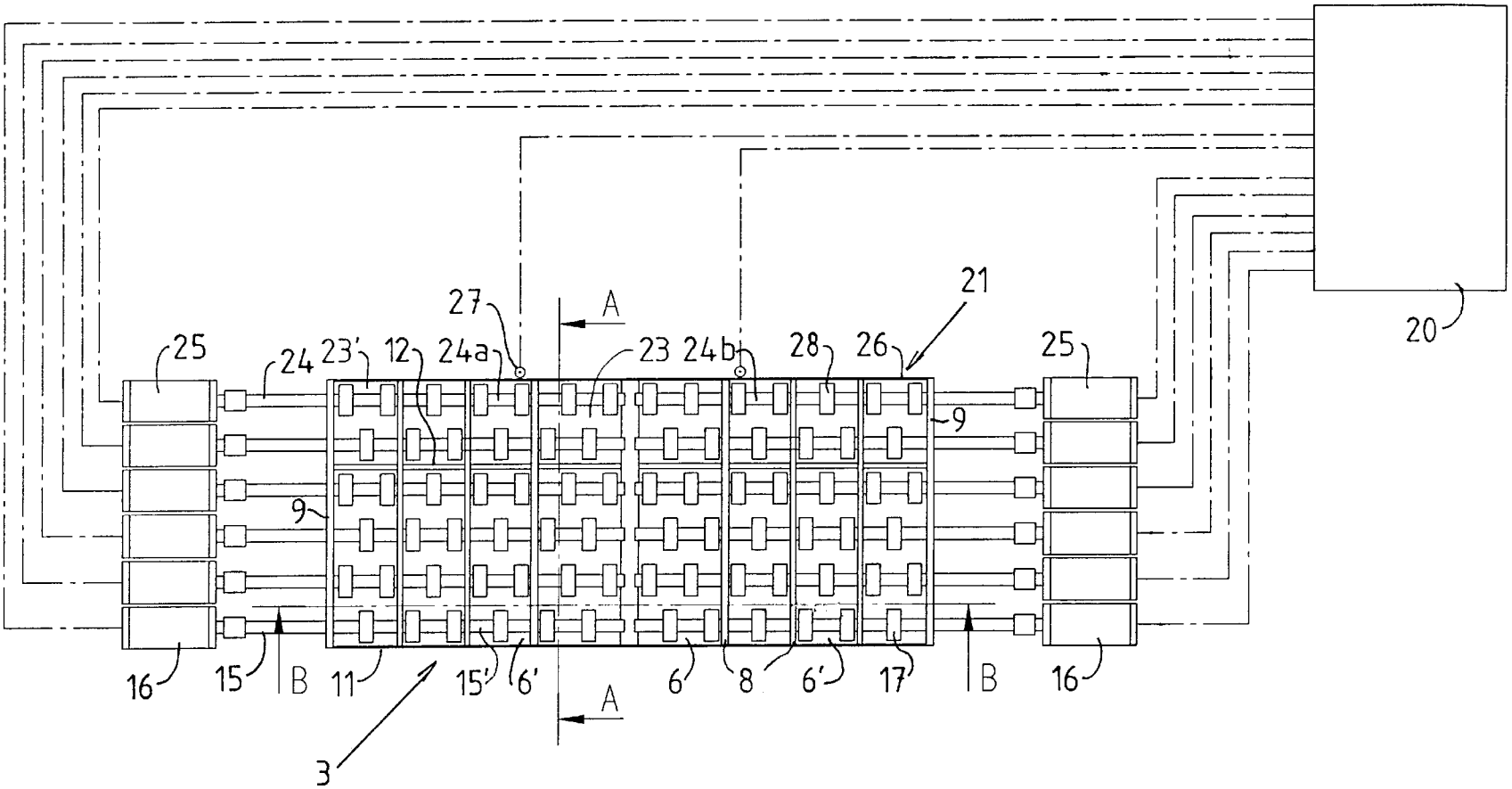
FIG. 1 is a schematic top plan view of an embodiment of a sheet-feeding device according to the invention, but without feeding table and sheet support for better clarity.
Figure 2:
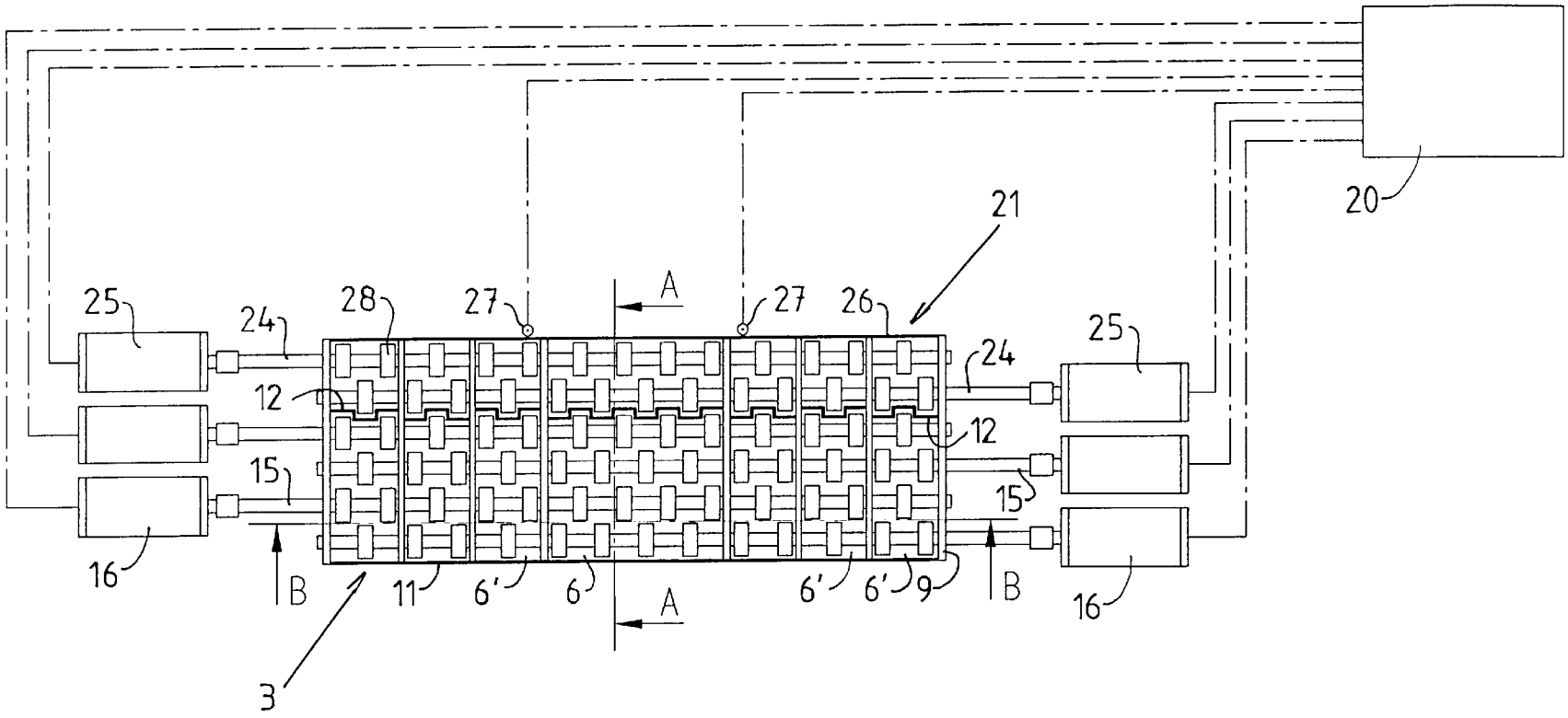
FIG. 2 is a view similar to that in FIG. 1 showing an alternative embodiment of a sheet-feeding device according to the invention.

As is evident from FIGS. 1–3, the device according to the invention also comprises a second low-pressure chamber 21, which is designed correspondingly to the first low-pressure chamber 3 and whose feeding table 22 forms an extension of, or is integrated with, the feeding table 4, that is, the tables 3 and 22 are in the same plane. As is further evident from FIG. 3, the low-pressure chambers are joined to one another (they have a common end wall 12, see FIGS. 1 and 2) and the second low-pressure chamber 21 is positioned between the first low-pressure chamber 3 and said transportation device 2. The central low-pressure compartment 23 of the second low-pressure chamber 21, cf. the central low-pressure chamber 6, is connected to a suction fan or a suction pump which is not necessarily the same as that of the low-pressure compartment 6, that is, the negative pressure may be different in the low-pressure compartments 6 and 23. Besides, low-pressure compartments 23', which are arranged on either side, as well as openings 13 and flaps 14 are arranged in the second low-pressure chamber. Furthermore, at least the last shaft 24(6) (in the direction of transportation) in the second low-pressure chamber 21 may be divided into two shaft portions 24*a* and 24*b*, which has been discussed in connection with the shafts 15 of the first low-pressure chamber 3 and, preferably, in certain applications, all the shafts 24 in the second low-pressure chamber 3 are divided in an indicated manner and each shaft portion 24*a*, 24*b* has its own motor 25 which is connected to said control unit 20. In other applications no shaft 24 is divided, cf. FIG. 2. Preferably, the spacing of the shafts 24 of the second low-pressure chamber, and the distance between the last shaft 15(4) of the first low-pressure chamber in the direction of transportation and the first shaft 24(5) of the second low-pressure chamber in the direction of transportation, is the same as the spacing of the shafts 15 of the first low-pressure chamber, which is evident from FIGS. 1–3. More preferably, the distance between the shafts 15(4) and 24(5) is shorter than the distance between the shafts 15 in the first low-pressure chamber 3 and between the shafts 24 in the second low-pressure chamber 21, respectively.

As is the case for the shafts 15 in the first low-pressure chamber, the shafts 24 in the second low-pressure chamber 21 are journalled in the partition walls 8 and are in the same (horizontal) plane. A plurality of wheels 28 are fixedly (and detachably) arranged on each shaft 24 and have friction lining of, for example, polyurethane on its peripheral surface.

Also the feeding table 22 is provided with a plurality of openings 29 which in number correspond to the total number of wheels 28 and the wheels 28 protrude a short distance (about 3–5 mm) above the feeding table, see FIG. 3. The openings 29 do not fit tightly round the wheels 28, whereby negative pressure is generated on the upper side of the feeding table 22 by means of suction effect from the low-pressure compartments 23, 23', which has been discussed above.

The distance between the shafts, the diameters of the wheels, the distance between the wheels and the feeding table are adapted so that thin sheets will not collapse and besides there is a safe hold of the sheet during the feeding phase. The wheels overlap in order to obtain maximum bearing capacity in relation to the sheets.

Figure 5:
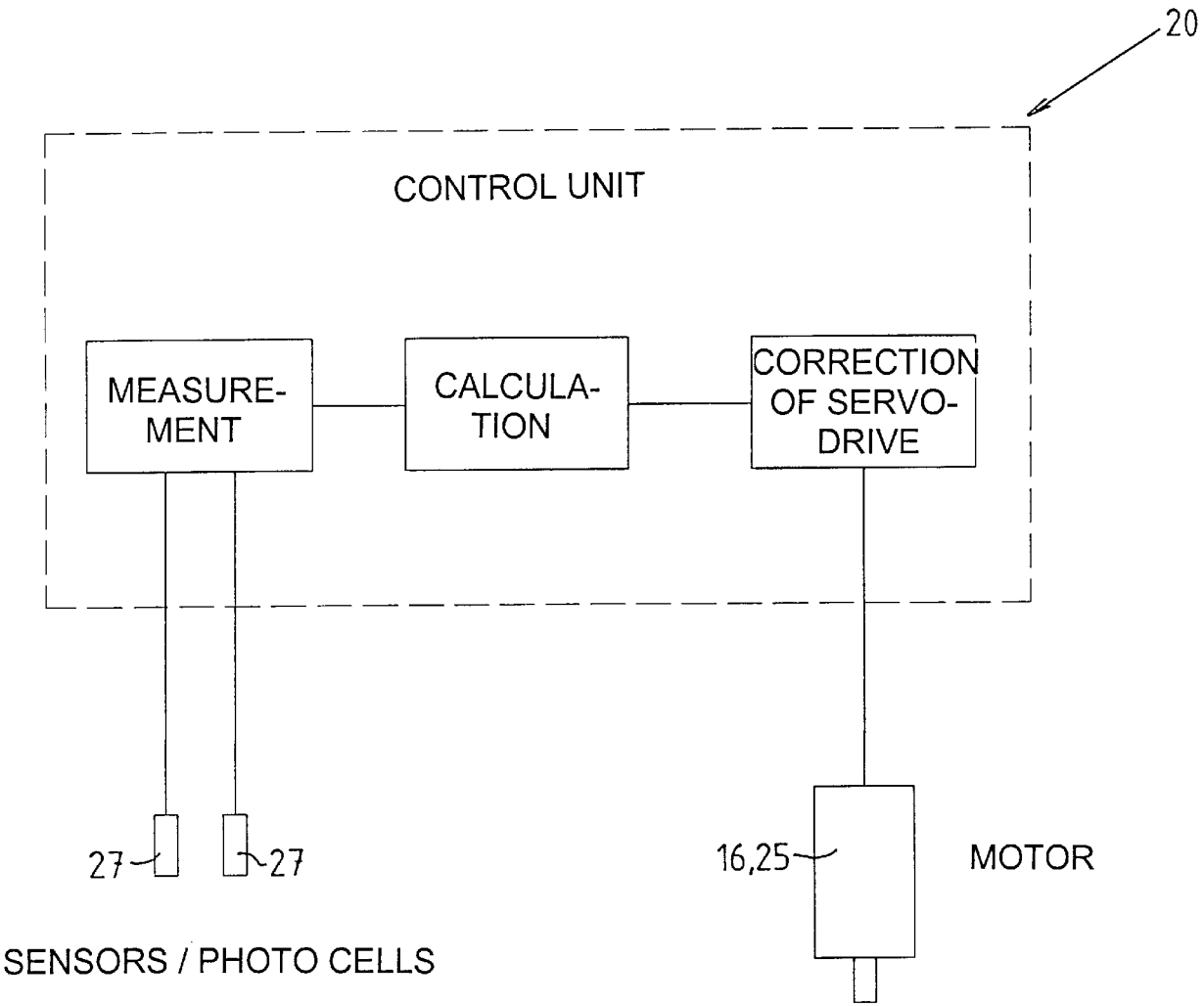

In the second low-pressure chamber 21, and preferably, at the end wall 26 of the chamber closest to the transportation device 2, one or more sensors 27 are arranged, for example, a couple of photocells. These are positioned at a relatively large distance from one another, for instance, corresponding to the width of the central low-pressure compartments 6, 23 as is evident from FIGS. 1 and 2. The sensors 27 are in a common plane which is parallel to the shafts 15, 24 (and thus also to the sheet support 19) and which is essentially perpendicular to the feeding tables 4, 22. They detect the front edge of the sheet at two points and, by means of these, it is possible to measure index and oblique feeding and, by means of the control unit 20 and the divided shafts 24 (and 15), for example the shaft portions 24*a* and 24*b*, if necessary, to correct index deviation and angular errors by decelerating the drive motor of one shaft portions (24*a*) and/or accelerate the speed of the drive motor of the other, opposite shaft portion (24*b*). This is carried out by sending signals regarding the front edge of the fed sheet in the direction of transportation to the control unit 20 which compares the actual value with a programmed reference value and sends corresponding correction directions to the above-mentioned motor(s), whereby correction of the position of the sheet is carried out before the sheet is transferred to the transportation device 2. In FIG. 5, the control unit 20 has been illustrated schematically connected to one motor 25 only, but as discussed above, the control unit is able to control the number of revolutions of more than one motor. If it is desired to compensate for index deviation, only one sensor needs to be arranged (not shown). It is then positioned at the same location as any one of the sensors 27 in FIGS. 1 or 2, or at a location between their positions. If only correction of index deviation is desired, all the shafts are advantageously undivided, i.e. the embodiment of the invention according to FIGS. 2 and 4*b*.

The control unit 20 has yet another purpose, namely, to accelerate and decelerate the shafts 15, 24 and, thus, the feeding wheels 17 and 28, respectively, which are attached to the shafts during a sheet-feeding cycle on the one hand in order to move the sheets from the sheet-feeding cycle to the transportation device at the correct production line, and, on the other hand, in order to prevent the sheets from getting stuck or being damaged on the sheet support or in the gap between the sheet support and the feeding table. This has been illustrated graphically in FIG. 6.

Figure 6:
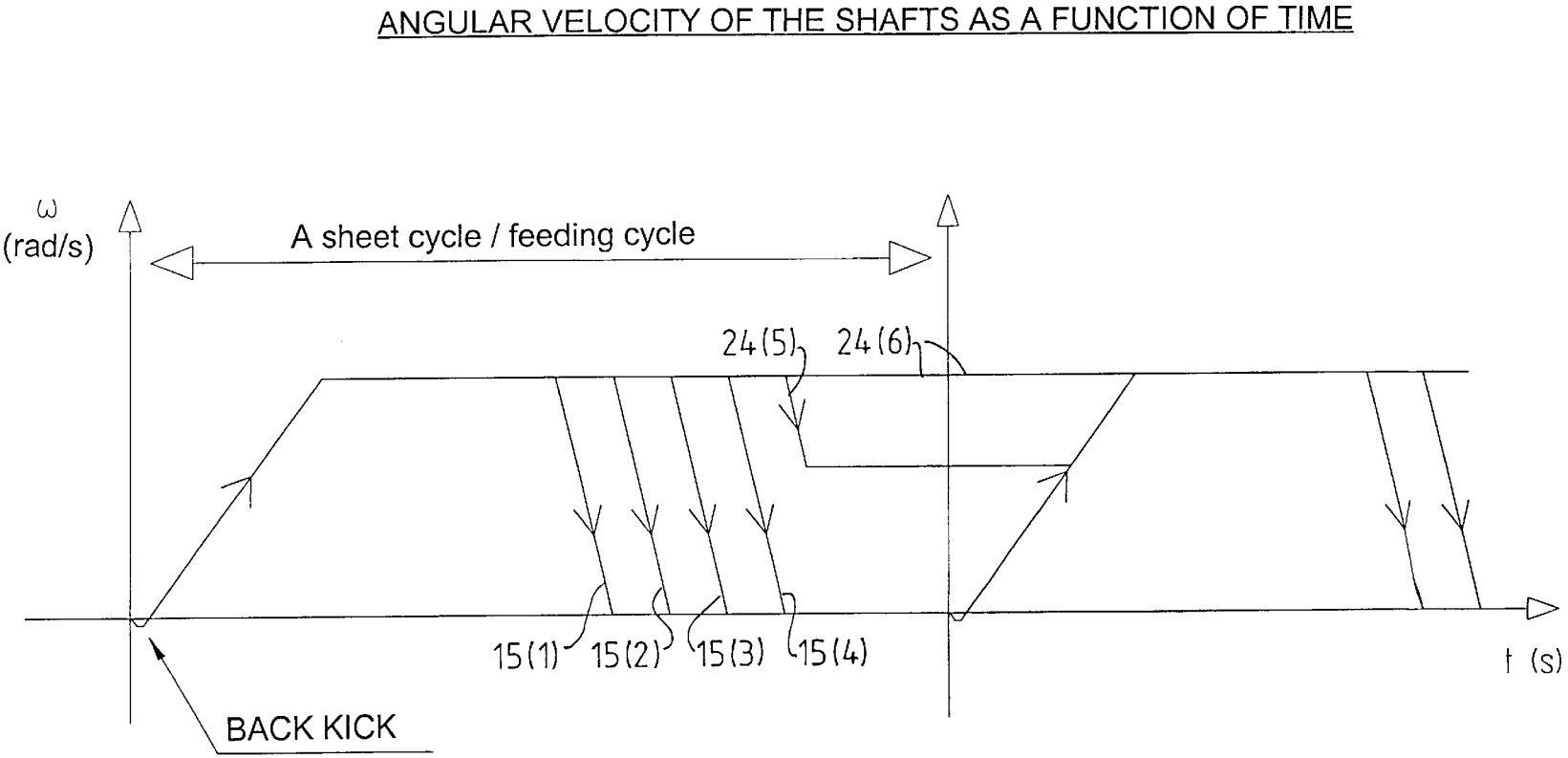
FIG. 6 shows in the form of a diagram the angular velocity of the respective shafts of the feeding wheels as a function of time and during a sheet-feeding cycle.

In FIG. 6 a sheet-feeding cycle have been illustrated for the sheet-feeding device presented above, that is, a device which has four shafts 15(1)–15(4) journalled in the first low-pressure chamber 3 and two shafts 24(5)–24(6) journalled in the second low-pressure chamber 21. FIG. 6 shows the angular velocity of the shafts as a function of time. As stated above, the motors 16, 25 are controlled individually by the control unit. In the beginning of a feeding cycle, all the motors are started simultaneously and accelerate the sheet 1, so that it reaches its position reference value and its speed reference value.

The shafts 15(1)–15(4) are driven by a speed profile which starts a feeding cycle with immobile shafts and with a sheet resting on their wheels. In the beginning of a feeding cycle, all the shafts start simultaneously and accelerate from a standstill to production line. By static friction between sheet and wheels, the lowermost sheet follows the forward movement and is fed forward in the direction of transportation (arrow 5 in FIG. 3).

When the sheet is fed forward in the sheet-feeding device, its rear edge will reach contact points on the periphery of the wheels. First the rear edge reaches the shaft 15(1), then the other shafts 15(2), 15(3) and 15(4) in succession. In order not to feed the next sheet of the sheaf, the wheels have to be stopped immediately before the sheet is sucked down onto the wheels. See graph 15(1) in FIG. 6.

The rear edge of the sheet first reaches the shaft 15(1) which stops immediately, then the shaft 15(2) which also stops immediately. This is repeated for the remaining two shafts before the sheet support 19 of the table. This movement pattern is programmed in the checking program (cam profile) of the control unit for the respective shafts. The distance which the periphery of a wheel of a shaft is to rotate before the rear edge is reached, is controlled by the control system and is programmed for the actual sheet length used in the machine at the moment.

A short distance after the sheet support, the front edge of the sheet reaches the shaft 24(5). This occurs before the sheet has accelerated to full production line, and, thus, also this shaft needs a movement pattern (cam pattern) which is adapted thereto. This movement pattern does not have to start its movement from the initial speed, but only has to meet the sheet at the speed which the sheet has achieved when it reaches the shaft 24(5). See graph 24(5). This implies that the acceleration and retardation work does not have to be as extensive for this shaft as for the four first shafts.

Thus, smooth acceleration of the sheet during a long distance is obtained (without the sheet "plunging" between the wheels). The short spacing of the shafts allows very short sheets to be fed.

When the front edge of the sheet reaches the shaft 24(6), the sheet 1 has achieved the production line of the machine. The shaft 24(6) thus moves at a constant number of revolutions which corresponds to the production line of the machine, that is, the shaft 24(6) always rotates and never stops from one sheet-feeding cycle to another. See graph 24(6).

In order to enable the feeding of sheets short in the direction of transportation, it is advantageous that the shafts after the sheet support are as close to the sheet support as possible. At the same time it is desirable that the sheet have an acceleration that is not too strong and, thus, the shaft which is closest to the sheet support follows a cam (movement pattern), while the furthest runs at a constant speed. As is evident from FIG. 6, the control unit is programmed to start each sheet-feeding cycle by initially rotating all the shafts in the first low-pressure chamber in a direction opposite of the direction of transportation, whereby the sheet which is to be fed is moved backwards a short distance away from the sheet support in order to detach the front edge of the sheet from the sheet support. Subsequently, the shafts are caused to rotate in the direction of transportation and the sheet can pass beneath the sheet support without being damaged or getting stuck.

The control unit 20 is connected to the speed (machine speed) and position of the transportation device 2 or of the subsequent process step (printing, slitting, punching or folding) in order to adapt the sheet-feeding speed (the acceleration of the motors) and the position of the sheet thereto. The control of the acceleration and retardation of the feeding wheels 17, 28 follows various principles of control for optimal sheet feeding. In order to obtain a controlled and uniform feeding from sheet to sheet, it is essential that the acceleration of the sheet is as slow as possible. However, lower acceleration results in maximum, fed sheet length or maximum machine speed being decreased, whereby the acceleration yet is aimed at being the highest possible for the size of sheet and quality in question. If the control is carried out in such a manner that decreased machine speed gives decreased acceleration, the adaptation of the acceleration is automatically achieved. This is realized by always letting the sheets accelerate during a constant distance which, if the speed is decreased, results in decreased acceleration.

When the speed is decreased, also the retardation will decrease and, thus, the time it takes for the wheels to stop is prolonged, and consequently, there will be enough time for the next sheet of the sheaf to be sucked down onto the wheels before they have stopped. As a result, the surface layer of the sheet can be damaged by the wheels which spin intensively against the same ("rubbing") and the sheet can be advanced to the front sheet support in an uncontrollable manner. In order to decelerate the feeding wheels, it is extremely important that this takes place in the shortest possible time and that the deceleration time is transferred to the next sheet waiting to be fed during the next feeding cycle. If the control is formed so that the wheels are always decelerated/stopped by a maximum available torque from the motor, the deceleration time will always be as short as possible. Consequently, there will not be enough time for the next sheet of the sheaf to be sucked down onto the wheels before they have stopped. This principle also results in, at decreased machine speed, the deceleration time being shorter due to the initial speed of the wheels being lower. If the stop is controlled by retardation that is constant for all machine speeds, the shortest possible deceleration time is always obtained for every machine speed.

Figure 7A:
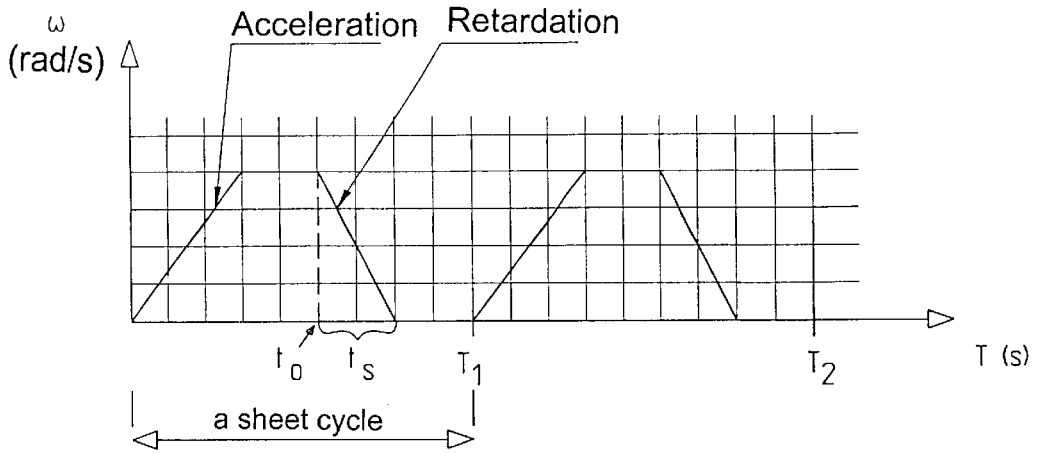
FIGS. 7*a*–8*b* show in the form of diagrams the acceleration and retardation graphs, respectively, of the shaft of a feeding wheel for various feeding speeds, FIG. 7 referring to a known sheet-feeding device and FIG. 8 to a device according to the invention.
Figure 7B:
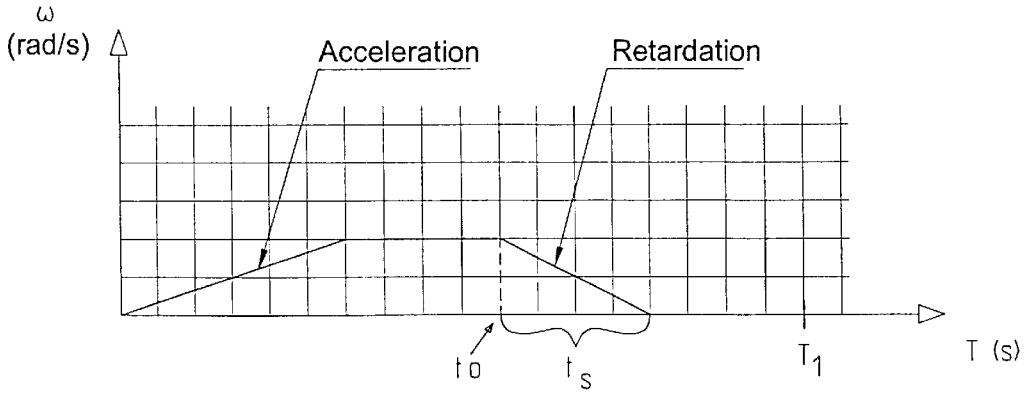

FIGS. 7*a* and 7*b* illustrate the rotary motion of a shaft for two different feeding speeds and for a conventional sheet-feeding device, such as the one that is presented in the already discussed U.S. Pat. No. 5,006,042. FIG. 7*a* shows the graph of a sheet-feeding cycle having maximum speed and FIG. 7*b* shows the graph of a sheet-feeding cycle having half the speed. As is evident from these figures, the absolute time during which the wheels are subject to acceleration and retardation is longer for 7*b* which shows a sheet-feeding cycle having half the speed. The retardation time ts is prolonged as much as the total cycle time $T_1$ is prolonged. In the case when the machine speed is halved, the cycle time and the retardation time are increased by a factor 2. This is a result of the current position control in the servo which is based on a preprogrammed cam pattern (movement pattern), that is, a position control in relation to the position in the cycle. (This way of controlling is practical since it is not necessary to do any reprogramming in connection with speed changes).

Figure 8A:
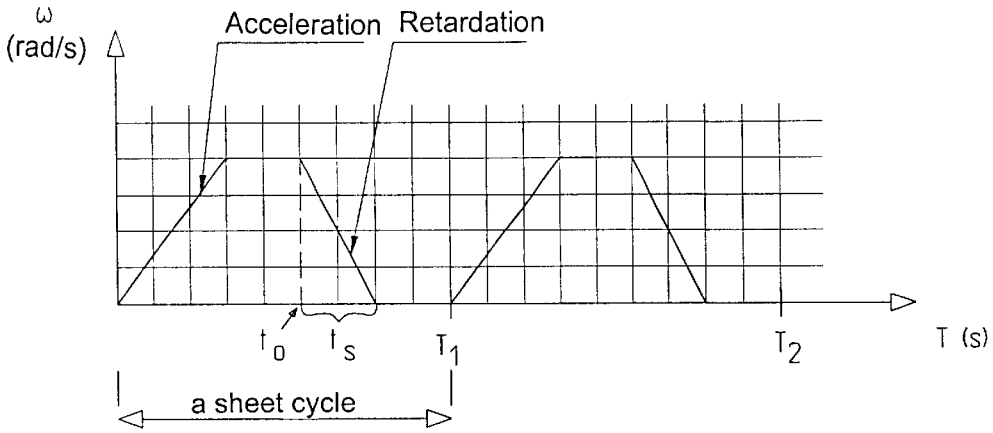
Figure 8B:
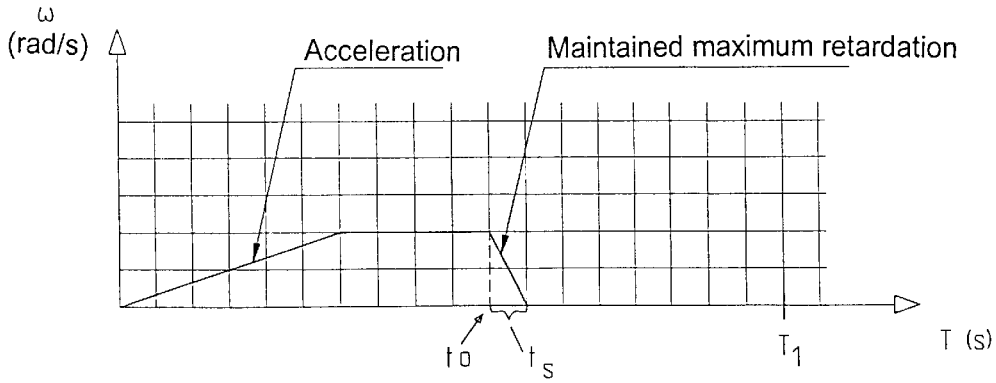

FIGS. 8*a* and 8*b* show the corresponding relationship for the sheet-feeding device according to the invention, FIG. 8 showing the graph of a sheet-feeding cycle having maximum speed and FIG. 8*b* shows the graph of a sheet-feeding cycle having half the speed. The graph refers to one of the shafts 15, for example, shaft 15(1). The retardation is at a maximum and occurs by means of a constant braking torque in the associated motor 16. In FIG. 8*b* the acceleration takes place at half the speed, the graph having the same inclination as in the corresponding conventional sheet-feeding, cf. FIG. 7*b*. The distance of acceleration is constant irrespective of the speed. At half the speed, the deceleration occurs by means of the same maximum, constant motor braking torque as at maximum speed, whereby the retardation graphs in FIGS. 8*a* and 8*b* get the same inclination. Consequently, the distance of deceleration is considerably reduced at half the speed compared to in a conventional sheet-feeding cycle, cf. FIGS. 7*a* and 7*b*. Optimally, the acceleration and retardation are thus controlled by various principles of control. Acceleration occurs during a constant distance and the stopping has a constant retardation irrespective of the machine speed. These two principles of control cooperate, so that when the machine speed is reduced, more favorable conditions of correct sheet feeding are obtained for both acceleration and retardation, and besides the control system can be trimmed in order to provide maximum performance at maximum machine speed. In practice, these principles have proved to be difficult to combine in the same control system.

In order to stop the rotation of the wheels in the shortest possible time regardless of the machine speed, the wheels are thus always decelerated by the maximum available torque of the motor. By decelerating by means of a constant maximum torque, the retardation graph will have the same inclination (i.e. the same deceleration speed) irrespective of the machine speed and lower machine speed will give a shorter deceleration time. This differs from the use of a standard graph (programmed in positions within a machine cycle), where the stop occurs in relation to a preprogrammed stopping position in the machine cycle. See FIGS. 7*a* and 7*b*.

The stopping position will be reached faster by means of the sheet-feeding cycle according to the invention than by means of a standard graph. This is feasible thanks to the fact that at the point where the rear edge of the sheet has reached the wheels, the control changes from a standard graph which is controlled by positions within the machine cycle to deceleration by means of maximum available torque/speed only. When the subsequent feeding cycle is started, connection to the movement pattern and position of the wheel shaft occurs again. This takes place when the speed of the wheel is zero, i.e. the wheel is at a standstill. This method also has the advantage of possible back kicking (i.e. too large adjustment) at the stopping point not generating any position errors which have to be recovered, resulting in extra "rubbing". If problems arise with sheet feeding, for instance, due to very large sheets or bad quality of the sheets, a safer feeding may take place by reducing the machine speed.

Figure 9A:
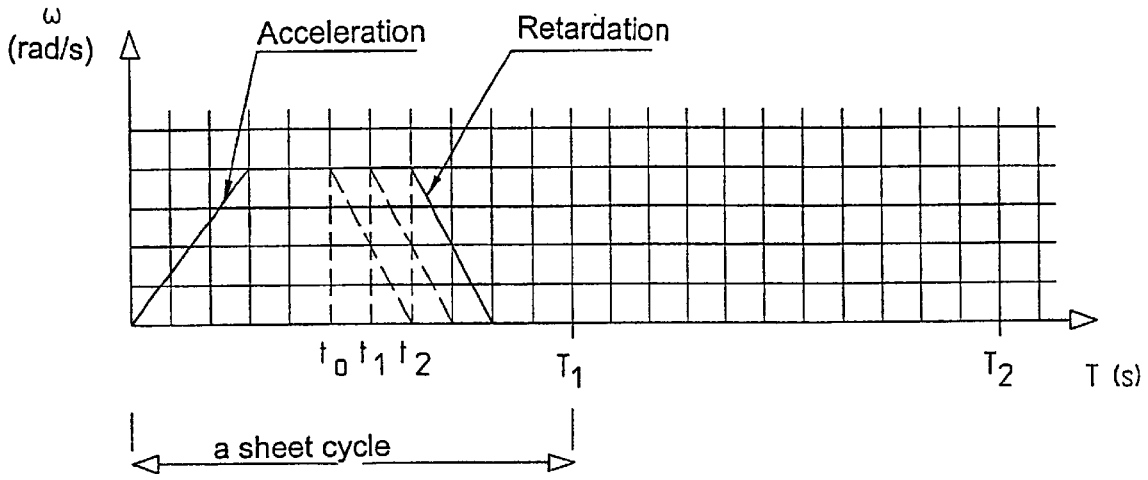
FIGS. 9*a*–9*b* show, as FIGS. 8*a*–8*b*, acceleration and retardation graphs, respectively, for various feeding speeds and various sheet lengths which apply to a device according to the invention.
Figure 9B:
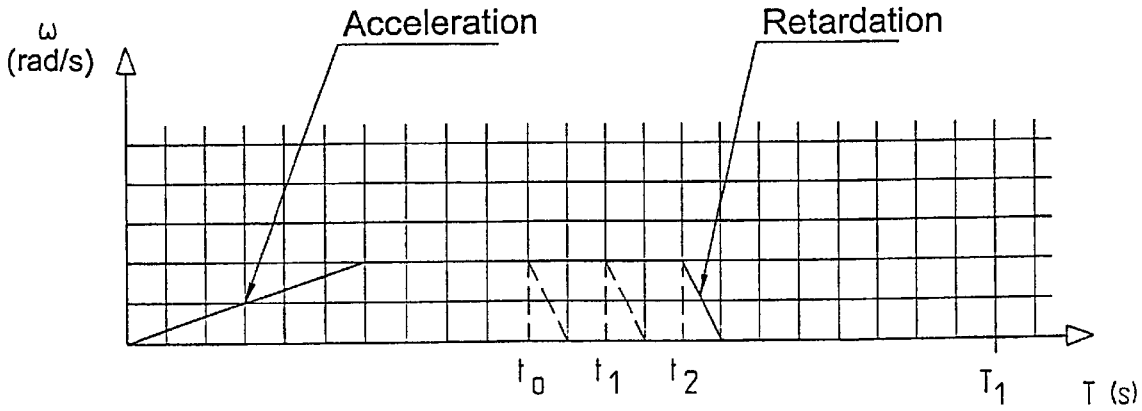

Another advantage is that changing the feeding length only means moving forward or moving back the position in the machine cycle to leave the position control, that is, the same start of the graph is always used irrespective of feeding length. This results in the advantage of a new cam pattern not having to be downloaded when changing the feeding length. FIG. 9*a* shows the retardation graph of various sheet lengths at maximum sheet-feeding speed and FIG. 9*b* shows the retardation graph of different sheet lengths at half the sheet-feeding speed when using the sheet-feeding device according to the invention. When using a standard feeding cycle according to FIGS. 7*a* and 7*b*, new graphs have to be created as regards every new sheet length. This means that the machine has to be stopped when a new cam is downloaded to the control unit.

Maintaining the graph when starting the acceleration of the sheet, gives the advantage of lower absolute acceleration in connection with reduced machine speed and, thus, a reduced slipping between sheet and wheels.

The invention is not limited to that described above or shown in the drawings, but can be changed within the scope of the accompanying claims.

I claim:

1. A device for feeding sheets one by one from a stack of sheets to a transportation device for transporting the sheet to a process station, the device comprising a first low-pressure chamber with an integrated feeding table which supports the stack of sheets, a number of separately driven shafts which are positioned perpendicular to a direction of transportation and are arranged in the low-pressure chamber essentially equidistantly spaced from one another and which each carry a plurality of wheels with friction lining, which protrude through associated openings in the feeding table, and a sheet support which is arranged essentially vertically above the feeding table and at a distance from the feeding table which is somewhat larger than a thickness of a sheet, wherein the device further comprises a second low-pressure chamber, between the first low-pressure chamber and the transportation device, having an integrated feeding table which forms an extension of the feeding table of the first low-pressure chamber, and a plurality of separately driven shafts are arranged in the second low-pressure chamber at essentially a same distance from one another and having a distance between adjacent shafts in the first low-pressure chamber and in the second low-pressure chamber, respectively, each shaft in the second low-pressure chamber carrying a plurality of wheels with friction lining, which protrude through associated openings in the feeding table of the second low-pressure chamber, at least one sensor being arranged between the second low-pressure chamber and the transportation device, the sensor being adapted to detect a position of a front edge of the fed sheet and to send signals to a control unit, and wherein the control unit is adapted to correct, if necessary, the position of the front edge of the sheet by controlling drive motors of the shafts.

2. A device as claimed in claim 1, wherein at least one of the shafts comprises two-spaced-apart shaft portions which are aligned with one another and which are each driven by a separate motor, at least two sensors are arranged at a distance from one another, parallel to the shafts and between the second low-pressure chamber and the transportation device, the sensors being adapted to detect the position of the front edge of the fed sheet and to send signals to the control unit, and the control unit is adapted to correct an angular position of the front edge of the sheet by controlling the drive motor of the at least one shaft portion.

3. A device as claimed in claim 2, wherein the first low-pressure chamber extends past the sheet support, and one of its shafts is positioned essentially in the same plane as the sheet support.

4. A device as claimed in claim 2, wherein each low-pressure chamber comprises a number of partition walls, which are oriented transversely to the shafts and divide each low-pressure chamber into separate compartments, a vacuum source is connected to a centrally arranged, separate compartment in each low-pressure chamber, and each partition wall exhibits at least one opening which is closable by means of an operable flap.

5. A device as claimed in claim 2, wherein the shaft in the second low-pressure chamber which is positioned closest to the sensors is divided.

6. A device as claimed in claim 2, wherein the control unit is connected to each motor in order to simultaneously start and accelerate the shafts and the associated wheels in the first low-pressure chamber, in order to move a sheet which rests on the wheels in the direction of transportation, and to make the shafts stop in succession when a rear edge of the sheet leaves the wheels, the control unit is arranged to reduce a speed of the shaft in the second low-pressure chamber closest to the sheet support at the end of each sheet-feeding cycle and to make remaining ones of the shafts in the second low-pressure chamber continuously rotate with a same number of revolutions, but allowing correction of the angular position of the front edge of the sheet.

7. A device as claimed in claim 2, wherein the control unit is connected to the transportation device to adapt acceleration of the motors to a speed of the transportation device, while the control unit is adapted to stop the motors by means of an available maximum torque irrespective of the speed of the transportation device.

8. A device as claimed in claim 1, wherein the first low-pressure chamber extends past the sheet support, and one of its shafts is positioned essentially in the same plane as the sheet support.

9. A device as claimed in claim 8, wherein each low-pressure chamber comprises a number of partition walls, which are oriented transversely to the shafts and divide each low-pressure chamber into separate compartments, a vacuum source is connected to a centrally arranged, separate compartment in each low-pressure chamber, and each partition wall exhibits at least one opening which is closable by means of an operable flap.

10. A device as claimed in claim 8, wherein the shaft in the second low-pressure chamber which is positioned closest to the sensors is divided.

11. A device as claimed in claim 8, wherein the control unit is connected to each motor in order to simultaneously start and accelerate the shafts and the associated wheels in the first low-pressure chamber, in order to move a sheet which rests on the wheels in the direction of transportation, and to make the shafts stop in succession when a rear edge of the sheet leaves the wheels, the control unit is arranged to reduce a speed of the shaft in the second low-pressure chamber closest to the sheet support at the end of each sheet-feeding cycle and to make remaining ones of the shafts in the second low-pressure chamber continuously rotate with a same number of revolutions, but allowing correction of an angular position of the front edge of the sheet.

12. A device as claimed in claim 1, wherein each low-pressure chamber comprises a number of partition walls, which are oriented transversely to the shafts and divide each low-pressure chamber into separate compartments, a vacuum source is connected to a centrally arranged, separate compartment in each low-pressure chamber, and each partition wall exhibits at least one opening which is closable by means of an operable flap.

13. A device as claimed in claim 12, wherein each low-pressure chamber is connected to an associated vacuum source.

14. A device as claimed in claim 1, wherein the shaft in the second low-pressure chamber which is positioned closest to the sensors is divided.

15. A device as claimed in claim 1, wherein the control unit is connected to each motor in order to simultaneously start and accelerate the shafts and the associated wheels in the first low-pressure chamber, in order to move a sheet which rests on the wheels in the direction of transportation, and to make the shafts stop in succession when a rear edge of the sheet leaves the wheels, the control unit is arranged to reduce a speed of the shaft in the second low-pressure chamber closest to the sheet support at the end of each sheet-feeding cycle and to make remaining ones of the shafts in the second low-pressure chamber continuously rotate with a same number of revolutions, but allowing correction of an angular position of the front edge of the sheet.

16. A device as claimed in claim 15, wherein the control unit at the beginning of each sheet-feeding cycle causes all the shafts in the first low-pressure chamber to rotate in a direction opposite to the direction of transportation and subsequently makes the shafts rotate in the direction of transportation.

17. A device as claimed in claim 1, wherein the control unit is connected to the transportation device to adapt acceleration of the motors to a speed of the transportation device, while the control unit is adapted to stop the motors by means of an available maximum torque irrespective of the speed of the transportation device.

18. A method for feeding sheets one by one from a stack of sheets in a feeding device to a transportation device for transporting the sheet to a process station, the feeding device comprising a low-pressure chamber with an integrated feeding table which supports the stack of sheets, a number of separately driven shafts which are positioned perpendicular to the direction of transportation and are arranged in the low-pressure chamber essentially equidistantly spaced from one another and which each carry a plurality of wheels with friction lining, which protrude through associated openings in the feeding table, and a sheet support which is arranged essentially vertically above the feeding table and at a distance from the feeding table which is somewhat larger than the thickness of the sheet, comprising:

feeding a lowermost sheet in the stack to the transportation device;

preventing a second lowermost sheet from being moved by means of a sheet support;

subjecting a surface of the lowermost sheet and the second lowermost sheet, respectively, which is exposed to the feeding device to suction in order to increase contact pressure against the wheels;

causing the wheels to rotate from an immobile condition at a beginning of each feeding cycle by a control unit which is connected to the drive motors of the wheels and the process station, in order to accelerate the sheet, so that the sheet reaches its position reference value and its speed reference value depending on a working pace of the process station; and bringing the wheels, when the sheet leaves the wheel to a standstill by means of the maximum braking torque available.

19. A method as claimed in claim 18, wherein, at the beginning of each sheet-feeding cycle, the lowermost sheet is moved a minimum distance in a direction opposite to a direction of transportation and the sheet is subsequently moved in the direction of transportation.

20. A method as claimed in claim 18, wherein, at the end of each sheet-feeding cycle, alignment of a front edge of the sheet in the feeding direction is detected and, if necessary, a position of the front edge of the sheet is corrected before the sheet is fed to the transportation device.

* * * * *